US005705303A

United States Patent [19]

Ichimura et al.

[11] Patent Number: 5,705,303

[45] Date of Patent: Jan. 6, 1998

[54] TONER COMPOSITION FOR ELECTROPHOTOGRAPHY

[75] Inventors: Masanori Ichimura; Michio Take; Susumu Saito, all of Minami-ashigara, Japan

[73] Assignee: Fuji Xerox Co., Ltd., Tokyo, Japan

[21] Appl. No.: 616,760

[22] Filed: Mar. 15, 1996

Related U.S. Application Data

[63] Continuation of Ser. No. 388,633, Feb. 14, 1995, abandoned.

[30] Foreign Application Priority Data

Feb. 17, 1994 [JP] Japan ..... 6-041808

[51] Int. Cl.[6] ..... G03G 9/08

[52] U.S. Cl. ..... 430/110

[58] Field of Search ..... 430/110

[56] References Cited

U.S. PATENT DOCUMENTS

| | | | |
|---|---|---|---|
| 3,650,686 | 3/1972 | Hudson et al. | 23/109 |
| 4,233,202 | 11/1980 | Berger et al. | 260/348.36 |
| 4,801,396 | 1/1989 | Altenschöpfer et al. | 252/99 |
| 5,157,007 | 10/1992 | Domesle et al. | 502/66 |
| 5,192,637 | 3/1993 | Saito et al. . | |
| 5,320,925 | 6/1994 | Imai et al. | 430/110 |
| 5,372,905 | 12/1994 | Deusser et al. | 430/110 |

FOREIGN PATENT DOCUMENTS

| | | | |
|---|---|---|---|
| 0 237 038 | 9/1987 | European Pat. Off. . | |
| 523 654 | 1/1993 | European Pat. Off. | 430/110 |
| 42 02 695 | 8/1993 | Germany . | |
| 59-52255 | 3/1984 | Japan . | |
| 6-238847 | 11/1985 | Japan . | |
| 2-43563 | 2/1990 | Japan . | |
| 3-39307 | 6/1991 | Japan . | |
| 6-11866 | 1/1994 | Japan . | |

OTHER PUBLICATIONS

Brady, James E. & Gerard E. Humiston (1982) *General Chemistry*, third edition. New York: John Wiley & Sons, Inc. p. 15.

Klein, Cornelius & Cornelius S. Hurlbut, Jr. (1985) *Manual of Mineralogy*, twentieth edition. New York: John Wiley & Sons, Inc. pp. 304, 305, 570, 580.

Database WPI, Section Ch, Week 9302, Derwent Publications Ltd., London, GB; Class G06, AN 93-011855 & JP-A-04 337 739, 25 Nov. 1992—Abstract.

*Primary Examiner*—Christopher D. Rodee
*Attorney, Agent, or Firm*—Oliff & Berridge, P.L.C.

[57] ABSTRACT

A toner composition for electrophotography comprising toner particles comprising a binder and a colorant and an additive, wherein the additive is crystalline titanium dioxide fine particles which have been treated with a coupling agent and which have a specific surface area of 60 to 100 $m^2/g$ and a Karl Fischer moisture content of not more than 5% by weight. Compounds represented by formulae (I), (II) or (III) are used as the coupling agent:

$$R^1Si(X)_3 \quad (I)$$

$$R^{1'}R^2Si(X)_2 \quad (II)$$

$$R^{1'}R^2R^3SiX \quad (III)$$

wherein $R^1$ represents an alkyl group having 9 to 20 carbon atoms; $R^{1'}$ represents an alkyl group having 1 to 20 carbon atoms; $R^2$ and $R^3$ each represent a hydrogen atom, an alkyl group having 1 to 20 carbon atoms or an aryl group having 6 to 30 carbon atoms; and X represents a chlorine atom, an alkoxy group having 1 to 10 carbon atoms or an acetoxy-group having 3 to 5 carbon atoms.

15 Claims, No Drawings

TONER COMPOSITION FOR ELECTROPHOTOGRAPHY

This is a Continuation of application Ser. No. 08/388,633 filed Feb. 14, 1995, abandoned.

FIELD OF THE INVENTION

The present invention relates to an toner composition for electrophotography which is excellent in powder fluidity and causes no scratch or filming on a photoreceptor.

BACKGROUND OF THE INVENTION

In recent years, a toner having a reduced particle size has often been used in order to obtain high image quality. However, reduced size toners give rise to such problems as deterioration in cleanability, transfer properties and fluidity and powder scattering.

In order to solve these problems, it has been a practice usually followed to add an additive to toner particles externally. If an external additive is added to a reduced size toner so as to obtain the same coverage as in the case of a large size toner, the weight ratio of the additive to the toner weight would be remarkably high, resulting in causing comets or filming on a photoreceptor with a cleaning blade. To overcome the problems, it has been proposed to add titanium dioxide fine powder having been treated with an alkyltrialkoxysilane, wherein the alkyl group has 6 to 8 carbon atoms, to be hydrophobic as disclosed in JP-B-3-39307 (the term "JP-B" as used herein means an "examined published Japanese patent application"). This technique suppressed occurrence of comets or filming but the effect was insufficient.

The present inventors extensively investigated into the phenomena of comet or filming occurrence and found the following facts as a result. In using a toner composition containing an additive, a great number of agglomerates of the additive having a diameter of several microns to 10 μm and a height of about 1 μm are deposited on the surface of a photoreceptor. When the photoreceptor is cleaned with a cleaning blade, these agglomerates leave a gap between the blade and the photoreceptor. It follows that a foreign substance is nipped in the gap and drags to make a number of scratches of several microns in width. The scratches pose a serious problem in forming high quality full color images which are often solid images. In high quality full color images, the scratches appear as image defects on half tone areas where the amount of the toner is small, considerably deteriorating the image quality. As described above, conventional toners involve the problem that agglomerates of an externally added additive are deposited on the surface of a photoreceptor in spots, and it has been demanded to solve the problem.

SUMMARY OF THE INVENTION

An object of the present invention is to provide a toner composition for electrophotography in which an external additive is prevented from agglomerating and depositing on a photoreceptor to prevent occurrence of scratches, thereby obtaining a high quality image.

The other objects and effects of the present invention will be apparent from the following description.

The present inventors have conducted extensive investigations into additives. As a result, they have found that the above object of the present invention is achieved by using crystalline titanium dioxide fine particles which has been surface-treated with a coupling agent, with the average primary particle size, BET specific surface area and Karl Fischer moisture content of the particles adjusted to fall within a respective specific range. In general, an amorphous titanium dioxide has a large moisture absorption compared with crystalline one, because of a great number of hydroxy group present on the surface thereof. Originally, a crystalline titanium dioxide does not retain a moisture content more than the physical absorption on the surface thereof. The crystalline titanium dioxide for use in the present invention is further reduced the moisture content to achieve the above object. The present invention has been completed based on this finding.

The toner composition for electrophotography of the present invention comprises (i) toner particles comprising a binder and a colorant and (ii) an additive, wherein the additive is crystalline titanium dioxide fine particles (a) which have been treated with a coupling agent and (b) which have a specific surface area of from 60 to 100 $m^2/g$ and a Karl Fischer moisture content of not more than 5% by weight, the coupling agent being a compound represented by formula (I), (II) or (III):

$$R^1Si(X)_3 \quad (I)$$

$$R^{1'}R^2Si(X)_2 \quad (II)$$

$$R^{1'}R^2R^3SiX \quad (III)$$

wherein $R^1$ represents an alkyl group having 9 to 20 carbon atoms; $R^{1'}$ represents an alkyl group having 1 to 20 carbon atoms; $R^2$ and $R^3$ each represents a hydrogen atom, an alkyl group having 1 to 20 carbon atoms or an aryl group having 6 to 30 carbon atoms; and X represents a chlorine atom, an alkoxy group having 1 to 10 carbon atoms or an acetoxy group having 3 to 5 carbon atoms.

DETAILED DESCRIPTION OF THE INVENTION

The present invention will hereinafter be described in detail.

The binder resins which can be used in the present invention include homo- or copolymers of styrene or derivatives thereof, e.g., chlorostyrene; monoolefins, e.g., ethylene, propylene, butylene, and isobutylene; dienes, e.g., butadiene and isoprene; vinyl esters, e.g., vinyl acetate, vinyl propionate, and vinyl benzoate; α-methylene aliphatic monocarboxylic acid esters, e.g., methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and vinyl isopropenyl ketone; polyester resins, polyamide resins, polyimide resins, and polyurethane resins. Particularly, polyester resins are preferably used as the binder resin in the present invention. The polyester resin may be prepared by reacting a polyhydric alcohol and a polybasic carboxylic acid or a reactive derivative thereof.

The polyhydric alcohol component constituting the polyester resin includes diols, such as ethylene glycol, diethylene glycol, triethylene glycol, 1,2-propylene glycol, 1,3-propylene glycol, 1,3-butanediol, 1,4-butanediol, 2,3-butanediol, neopentyl glycol, cyclohexanediol and cyclohexanedimethanol; hydrogenated bisphenol A; bisphenol A-alkylene oxide adducts, such as a bisphenol A-polyethylene oxide adduct and a bisphenol A-polypropylene oxide adduct, for example, bisphenol derivatives represented by formula (IV):

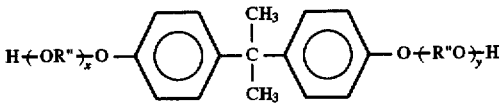

(IV)

wherein R" is an ethylene group or propylene group, and x and y each represents an integer of 1 or more, provided that the total of x and y is within the range of 2 to 6; and other dihydric alcohols. Of them, bisphenol A and bisphenol derivatives represented by formula (IV) are preferred.

The polybasic carboxylic acid component constituting the polyester resin includes malonic acid, succinic acid, adipic acid, sebacic acid, an alkylsuccinic acid, maleic acid, fumaric acid, mesaconic acid, citraconic acid, itaconic acid, glutaconic acid, cyclohexanedicarboxylic acid, isophthalic acid, terephthalic acid, and other dicarboxylic acids, and reactive derivatives of these acids, such as acid anhydrides, alkyl esters, and acid halides.

Further, a tri- or higher polyhydric alcohol and/or a tri- or higher polybasic carboxylic acid may be used so as to make the resulting polymer non-linear to such an extent that no tetrahydrofuran-insoluble content may occur.

Examples of suitable tri- or higher polyhydric alcohols are sorbitol, 1,2,3,6-hexanetetrol, 1,4-sorbitan, pentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trimethylolbenzene.

Examples of suitable tri- or higher polybasic carboxylic acids are 1,2,4-butanetricarboxylic acid, 1,2,4-cyclohexanetricarboxylic acid, 1,2,4-benzenetricarboxylic acid, 1,2,5-benzenetricarboxylic acid, 2,5,7-naphthalenetricarboxylic acid, pyromellitic acid, and reactive derivatives of these acids, such as acid anhydrides.

Preferred polyester resins prepared from the above-mentioned starting materials are linear polyester resins obtained by polycondensation of bisphenol A and an aromatic polycarboxylic acid as main monomer components. Polyester resins which are particularly preferred in the present invention include (i) a linear polyester formed from terephthalic acid/bisphenol A-ethylene oxide adduct/cyclohexanedimethanol, and further having a softening point of 90° to 150° C., a glass transition point of 50° to 70° C., a number average molecular weight of 2000 to 6000, a weight average molecular weight of 8000 to 150000, an acid value of 5 to 30, and a hydroxy group value of 25 to 45, and (ii) a linear polyester formed from terephthalic acid/bisphenol A-ethylene oxide adduct/cyclohexanediol, and further having a softening point of 100° to 125° C., a glass transition point of 55° to 68° C., a number average molecular weight of 3000 to 3600, a weight average molecular weight of 9000 to 10000, an acid value of 6 to 12, and a hydroxy group value of 25 to 40.

The colorants which can be used in the present invention typically include carbon black, Nigrosine, Aniline Blue, Calco Oil Blue, Chrome Yellow, Ultramarine Blue, Du Pont Oil Red, Quinoline Yellow, Methylene Blue chloride, Phthalocyanine Blue, Malachite Green oxalate, Lampblack, Rose Bengale, C. I. Pigment Red 48:1, C. I. Pigment Red 122, C. I. Pigment Red 57:1, C. I. Pigment Yellow 97, C. I. Pigment Yellow 12, C. I. Pigment Yellow 17, C. I. Pigment Blue 15:1, and C. I. Pigment Blue 15:3. The colorant may be subjected to flushing to have improved dispersibility.

The toner particles preferably contain from 1 to 8 parts by weight of a colorant per 100 parts by weight of a binder resin. If the amount of the colorant is less than 1 part, the toner tends to have an insufficient coloring power. If it exceeds 8 parts, the toner tends to have reduced transparency.

The toner particles preferably have an average particle size of not greater than 9 μm, and especially preferably from 5 to 9 μm. If the average particle size is greater than 9 μm, a high quality image is hardly obtained.

If desired, other additives, such as a charge control agent, a fixing aid, a fluidity improving agent, a parting agent, a cleaning aid, and so forth, may be added to the toner particles according to the present invention. Suitable additives include polymethyl methacrylate resins, polyvinylidene fluoride resins, and a high-molecular alcohol.

The additive externally added to the above-mentioned toner particles are described below.

In the present invention, crystalline titanium dioxide fine particles are used as an additive. The crystalline titanium dioxide fine particles preferably have a primary particle size of not more than 20 nm, preferably 5 to 20 nm, especially preferably 10 to 20 nm. If the primary particle size is less than 10 nm, the particles are liable to agglomerate to deteriorate dispersibility in mixing with toner particles, and the chargeability of the toner is sometimes reduced. If it is greater than 20 nm, powder fluidity is deteriorated, tending to cause obstruction in toner carrying.

It is essential for the additive to have a specific surface area of from 60 to 100 $m^2/g$. For ensured improvement in fluidity, the specific surface area is preferably from 70 to 95 $m^2/g$, still preferably from 75 to 95 $m^2/g$. If the specific surface area is smaller than 60 $m^2/g$, the fluidity is deteriorated. If it exceeds 100 $m^2/g$, the toner tends to scratch a photoreceptor to deteriorate image quality.

It is also essential that a Karl fisher moisture content of the additive is not more than 5% by weight. For ensured improvement in long-term stability, the moisture content is preferably not more than 4% by weight, still preferably not more than 3.5% by weight. If the moisture content is higher than 5% by weight, a photoreceptor tends to be scratched to deteriorate the image quality.

The terminology "specific surface area" as used herein means a BET specific surface area measured by a nitrogen adsorption method. A BET specific surface area can be measured with, for example, Kantasorb QS-16 manufactured by Kantachrome Co. in accordance with a flow type nitrogen adsorption BET one point method. That is, a sample is degassed at 200° C. for 15 minutes in a 100% nitrogen gas stream, cooled to liquid nitrogen temperature, and placed in a flow of $He/N_2$ mixed gas ($N_2$ 30%) to adsorb $N_2$. The adsorbed $N_2$ is desorbed at 20° C., and the amount of the released $N_2$ is determined with a heat conductivity detector. The thus calculated total surface area is divided by the dry weight (g) of the sample to obtain a specific surface area.

The Karl Fischer moisture content can be measured with a Karl Fischer's titration apparatus according to amperometric titration at constant voltage with two indicator electrode. The measurement is made with, for example, volumetric titration system moisture content measuring apparatus KF-06 manufactured by Mitsubishi Chemical Industries Ltd. That is, 10 μl of pure water is precisely weighed with a microsyringe, and a moisture content (mg) per ml of Karl Fischer's reagent is calculated from the titer of the reagent necessary for removing the above water. Then, a sample precisely weighing 100 to 200 mg is thoroughly dispersed in a measuring flask for 5 minutes by means of a magnetic stirrer. After dispersing, titration is started. The total weight of moisture of the sample and the weight of moisture per unit weight as a Karl Fischer moisture content are obtained from the total titer (ml) of Karl Fischer's reagent required for titration according to the following equations:

Total weight of moisture (mg)=titer (ml)×strength of reagent (mg $H_2O$/ml)

Moisture content (%)=

$$\frac{\text{total weight of moisture (mg)}}{\text{weight of sample (mg)}} \times 100$$

The specific surface area and Karl Fischer moisture content of the additive according to the present invention depend on the crystalline titanium dioxide fine particles per se. Therefore, these characteristics undergo almost no change by the surface treatment with the coupling agent.

The crystalline titanium dioxide used in the present invention is a powder exhibiting intense diffraction patterns in the powder X-ray diffraction. The crystalline titanium dioxide has several crystal forms such as rutile form (tetragonal system), anatase form (tetragonal system) and mixture thereof. Any of them can be used for the toner composition of the present invention. There may be also present an amorphous titanium dioxide which does not exhibit intense diffraction peaks in the X-ray crystalline diffraction, though, it can be subjected to crystallization by treating with e.g., heat.

The rutile crystal form of titanium dioxide has a rice-grain shape, a primary particle size of about 150 to 3000 Å, a true specific gravity of about 4.2 and a number of hydroxy group on surface per gram of about $1.4\times10^{20}$. The anatase crystal form of titanium dioxide has almost the same property as the rutile crystal for except for having a true specific gravity of about 3.9.

The crystalline titanium dioxide fine particles can be prepared by a wet process comprising decomposition of ilmenite ore with sulfuric acid, hydrolysis, neutralization, and calcination and a wet process comprising evaporating a titanium alkoxide under heating followed by pyrolysis at 250° to 600° C. in the presence of a catalyst and water. The particle size, i.e., the specific surface area, can be controlled by adjustment of conditions in the above-described preparation, such as pH, reaction temperature, and reaction time. The specific surface area of the resulting particles may be increased by grinding to irregular particles.

The Karl Fischer moisture content of the particles can be reduced to 5% by weight or lower by treating at a high temperature of at least 300° C. for 30 minutes or more.

The crystalline titanium dioxide fine particles of the present invention is required to be treated with a coupling agent. Coupling agents represented by formulae (I), (II) or (III) are preferably used in the present invention:

$$R^1Si(X)_3 \quad \text{(I)}$$

$$R^{1'}R^2Si(X)_2 \quad \text{(II)}$$

$$R^{1'}R^2R^3SiX \quad \text{(III)}$$

wherein $R^1$ represents an alkyl group having 9 to 20 carbon atoms, preferably 10 to 20 carbon atoms; $R^{1'}$ represents an alkyl group having 1 to 20 carbon atoms, preferably 10 to 20 carbon atoms; $R^2$ and $R^3$ each represent a hydrogen atom, an alkyl group having 1 to 20 carbon atoms or an aryl group having 6 to 30 carbon atoms; and X represents a chlorine atom, an alkoxy group having 1 to 10 carbon atoms, preferably 1 to 5 carbon atoms or an acetoxy group having 3 to 5 carbon atoms.

Examples of the coupling agents of formula (I) include $CH_3(CH_2)_8Si(OCH_3)_3$, $CH_3(CH_2)_9Si(OCH_3)_3$, $CH_3(CH_2)_{10}Si(OCH_3)_3$, $CH_3(CH_2)_{11}Si(OCH_3)_3$, $CH_3(CH_2)_{12}Si(OCH_3)_3$, $CH_3(CH_2)_{13}Si(OCH_3)_3$, $CH_3(CH_2)_{14}Si(OCH_3)_3$, $CH_3(CH_2)_{15}Si(OCH_3)_3$, $CH_3(CH_2)_{16}Si(OCH_3)_3$, $CH_3(CH_2)_{17}Si(OCH_3)_3$, $CH_3(CH_2)_{18}Si(OCH_3)_3$, $CH_3(CH_2)_{19}Si(OCH_3)_3$, $CH_3(CH_2)_8Si(OC_2H_5)_3$, $CH_3(CH_2)_9Si(OC_2H_5)_3$, $CH_3(CH_2)_{10}Si(OC_2H_5)_3$, $CH_3(CH_2)_{11}Si(OC_2H_5)_3$, $CH_3(CH_2)_{12}Si(OC_2H_5)_3$, $CH_3(CH_2)_{13}Si(OC_2H_5)_3$, $CH_3(CH_2)_{14}Si(OC_2H_5)_3$, $CH_3(CH_2)_{15}Si(OC_2H_5)_3$, $CH_3(CH_2)_{16}Si(OC_2H_5)_3$, $CH_3(CH_2)_{17}Si(OC_2H_5)_3$, $CH_3(CH_2)_{18}Si(OC_2H_5)_3$, and $CH_3(CH_2)_{19}Si(OC_2H_5)_3$.

Examples of the coupling agents of formula (II) include $(CH_3)_2SiCl_2$, $(CH_3)_2Si(OCH_3)_2$, $(CH_3)_2Si(OC_2H_5)_2$, $(CH_3)(CH_3CH_2)Si(OCH_3)_2$, $(CH_3)[CH_3(CH_2)_2]Si(OCH_3)_2$, $(CH_3)[CH_3(CH_2)_3]Si(OCH_3)_2$, $(CH_3)[CH_3(CH_2)_4]Si(OCH_3)_2$, $(CH_3)[CH_3(CH_2)_5]Si(OCH_3)_2$, $(CH_3)[CH_3(CH_2)_6]Si(OCH_3)_2$, $(CH_3)[CH_3(CH_2)_7]Si(OCH_3)_2$, $(CH_3)[CH_3(CH_2)_8]Si(OCH_3)_2$, $(CH_3)[CH_3(CH_2)_9]Si(OCH_3)_2$, $(CH_3)[CH_3(CH_2)_{10}]Si(OCH_3)_2$, $(CH_3)[CH_3(CH_2)_{11}]Si(OCH_3)_2$, $(CH_3)[CH_3(CH_2)_{12}]Si(OCH_3)_2$, $(CH_3)[CH_3(CH_2)_{13}]Si(OCH_3)_2$, $(CH_3)[CH_3(CH_2)_{14}]Si(OCH_3)_2$, $(CH_3)[CH_3(CH_2)_{15}]Si(OCH_3)_2$, $(CH_3)[CH_3(CH_2)_{16}]Si(OCH_3)_2$, $(CH_3)[CH_3(CH_2)_{17}]Si(OCH_3)_2$, $(CH_3)[CH_3(CH_2)_{18}]Si(OCH_3)_2$, and $(CH_3)[CH_3(CH_2)_{19}]Si(OCH_3)_2$.

Examples of the coupling agents of formula (III) include $(CH_3)_3SiCl$, $(CH_3)_3Si(OCH_3)$, $(CH_3)_3Si(OC_2H_5)$, $(CH_3)_2(CH_3CH_2)Si(OCH_3)$, $(CH_3)_2[CH_3(CH_2)_2]Si(OCH_3)$, $(CH_3)_2[CH_3(CH_2)_3]Si(OCH_3)$, $(CH_3)_2[CH_3(CH_2)_4]Si(OCH_3)$, $(CH_3)_2[CH_3(CH_2)_5]Si(OCH_3)$, $(CH_3)_2[CH_3(CH_2)_6]Si(OCH_3)$, $(CH_3)_2[CH_3(CH_2)_7]Si(OCH_3)$, $(CH_3)_2[CH_3(CH_2)_8]Si(OCH_3)$, $(CH_3)_2[CH_3(CH_2)_9]Si(OCH_3)$, $(CH_3)_2[CH_3(CH_2)_{10}]Si(OCH_3)$, $(CH_3)_2[CH_3(CH_2)_{11}]Si(OCH_3)$, $(CH_3)_2[CH_3(CH_2)_{12}]Si(OCH_3)$, $(CH_3)_2[CH_3(CH_2)_{13}]Si(OCH_3)$, $(CH_3)_2[CH_3(CH_2)_{14}]Si(OCH_3)$, $(CH_3)_2[CH_3(CH_2)_{15}]Si(OCH_3)$, $(CH_3)_2[CH_3(CH_2)_{16}]Si(OCH_3)$, $(CH_3)_2[CH_3(CH_2)_{17}]Si(OCH_3)$, $(CH_3)_2[CH_3(CH_2)_{18}]Si(OCH_3)$, and $(CH_3)_2[CH_3(CH_2)_{19}]Si(OCH_3)$.

$CH_3(CH_2)_nSi(OCH_3)_3$ (n is 8 to 19) is particularly preferred among the above-enumerated coupling agents.

The surface-treatment of the titanium dioxide particle is classified into two types, i.e. a dry method and a wet method. In the dry method, the titanium dioxide particles are dispersed in an alcohol or an organic solvent other than an alcohol, to which a coupling agent is added e.g., in forming an aqueous solution and then the water, alcohol, and organic solvent used are removed from the mixture to dry, and optionally followed by heating and grinding the dried product. In the wet method, a coupling agent is dissolved in water and, an alcohol or an organic solvent other than an alcohol and the solution was poured over the titanium dioxide particle while uniformly stirring using a blender such as a Henschel mixer, a super mixer and the like. Surface treating of crystalline titanium dioxide particles with a coupling agent can be carried out by a method in which crystalline titanium dioxide fine powder is immersed in a solvent solution of a coupling agent followed by drying, or a method in which a solution containing a coupling agent is sprayed onto crystalline titanium dioxide particles, followed by drying. The former method is preferred for forming a uniform coat.

The deposit amount of the coupling agent is preferably in the range of 0.1 to 25% by weight based on the surface treated-titanium dioxide fine particles.

If desired, the toner composition for electro-photography of the present invention may contain other known additives in combination with the above-mentioned surface-treated crystalline titanium dioxide fine particles. Useful other additives include inorganic fine powder, such as $SiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O\ (TiO_2)_n$, $Al_2O_3.2\ SiO_2$, $CaCO_3$, $MgCO_3$, $BaSO_4$, $MgSO_4$, $MoS_2$, silicon carbide, boron nitride, carbon black, graphite, and fluorinated graphite; and polymer fine powder, such as polystyrene, polycarbonate, polymethyl methacrylate, and polyvinylidene fluoride. These additives may be used either as they are or after being surface-treated and either individually or as a combination of two or more thereof. These other additives may be used in a proportion of 1:99 to 99:1 by weight to the surface-treated crystalline titanium dioxide particles.

The toner composition for electrophotography of the present invention is prepared by mixing toner particles with the above-described additive(s) in, e.g., a high-speed mixing machine, such as a Henschel mixer or a twin-cylinder mixer. The amount of the surface-treated crystalline titanium dioxide particles mixed with the toner particles is 0.05 to 20% by weight, preferably 0.1 to 10% by weight, based on the total amount of the surface-treated crystalline titanium dioxide and the toner particles used.

The toner composition for electrophotography of the present invention can be used as a one-component developer or a two-component developer. Carriers to be used in a two-component developer include iron powder, glass beads, ferrite powder, nickel powder, either as they are or after being coated with a resin.

The present invention will now be illustrated in greater detail with reference to Examples, but it should be understood that the present invention is not construed as being limited thereto. Unless otherwise indicated, all the parts and percents are by weight.

EXAMPLE 1 AND COMPARATIVE EXAMPLE 1

A) Preparation of Toner:

Linear polyester resin 100 parts (prepared from terephthalic acid, an ethylene oxide adduct of bisphenol A, and cyclohexanedimethanol; glass transition point: 62° C.; number average molecular weight: 4000; weight average molecular weight: 9500; acid value: 8; hydroxy group value: 25)

Magenta pigment (C. I. Pigment Red 57:1) 3 parts

The above components were kneaded in an extruder, ground in a jet mill, and classified by an air classifier to obtain magenta toner particles having an average particle size of 7 μm.

B) Preparation of Additive a:

One kilogram of crystalline titanium dioxide fine particles were mixed with a toluene solution of 100 g of $C_{10}H_{21}Si(OCH_3)_3$ in a kneader to conduct surface treatment. After drying, the particles were ground in a pin mill to prepare additives a of samples 1 to 17. The physical properties of the resulting additives are shown in Table 1. Sample Nos. 6 to 17 were inventive samples and sample Nos. 1 to 5 were comparative samples.

C) Preparation of Toner Composition:

One part of the additives a shown in Table 1 were respectively added to 100 parts of the toner particles having an average particle size of 7 μm obtained in (A), and the mixture was mixed in a Henschel mixer at a peripheral speed of 26 m/s for 5 minutes.

D) Preparation of Developer:

A ferrite carrier having a particle size of about 50 μm and coated with a methyl methacrylate-styrene copolymer and the toner composition prepared in (C) were mixed in a tumbler shaker mixer to prepare a developer having a toner content of 6%.

E) Evaluation and Standard of Evaluation:

1. Image Quality Grade and Scratches on Photoreceptor:

An electrophotographic digital copying machine Acolor 630 fitted with an organic photoreceptor was loaded with 650 g of each developer, and 30,000 copies were obtained in a continuous manner. The image quality on the half tone area was examined while observing occurrence of scratches on the photoreceptor and evaluated by visual evaluation in grades from G0 (good) to G5 (bad). A circle (○) (G0 to G2) means an acceptable level, and a cross (x) (G3 to G5) means below an acceptable level.

2. Fluidity:

Powder fluidity of the developer was evaluated in terms of whether or not obstruction occurs in the toner route from a toner feeding box through the developing machine. Developers causing no obstruction are indicated with a circle (○), and those causing obstruction are with a cross (x). A triangle (Δ) means an acceptable level.

F) Results of Evaluation:

The results obtained are shown in Table 1.

TABLE 1

| | Physical Property of Additive a | | | Characteristics of Developer | |
|---|---|---|---|---|---|
| Sample No. | BET Specific Surface Area ($m^2/g$) | Karl Fischer Moisture Content (wt %) | Primary Particle Size (nm) | Image Grade (Scratches on Photoreceptor) | Powder Fluidity |
| 1 | 148 | 14.5 | 13 | G5 x | ○ |
| 2 | 135 | 8.0 | 18 | G5 x | ○ |
| 3 | 100 | 5.2 | 30 | G3 x | ○ |
| 4 | 93 | 6.0 | 40 | G5 x | Δ |
| 5 | 90 | 5.9 | 30 | G3 x | Δ |
| 6 | 93 | 3.4 | 18 | G0 ○ | ○ |
| 7 | 99 | 4.5 | 18 | G0 ○ | Δ |
| 8 | 86 | 2.7 | 18 | G1 ○ | ○ |
| 9 | 84 | 4.6 | 18 | G1 ○ | ○ |
| 10 | 81 | 2.5 | 18 | G0 ○ | ○ |
| 11 | 78 | 3.0 | 25 | G2 ○ | Δ |
| 12 | 73 | 2.0 | 30 | G2 ○ | Δ |
| 13 | 70 | 2.9 | 25 | G2 ○ | Δ |
| 14 | 70 | 3.1 | 40 | G2 ○ | Δ |
| 15 | 68 | 2.5 | 30 | G2 ○ | Δ |
| 16 | 62 | 2.5 | 30 | G2 ○ | Δ |
| 17 | 60 | 2.0 | 30 | G1 ○ | Δ |

EXAMPLE 2 AND COMPARATIVE EXAMPLE 2

In addition to additive a used in Example 1 and Comparative Example 1, the following additives b and c were prepared.

Additive b:

A hundred grams of dry process silica having an average particle size of 40 nm (OX 50, produced by Nippon Aerosil Co., Ltd.) were treated with 15 g of hexamethyldisilazane in the same manner as for additive a.

Additive c:

$CH_3(CH_2)_xCH_2OH$ (x is about 40)

Additive a of Sample No. 1 or 10 in Example 1 was used in combination with additive b and additive c. These additives were mixed with a toner in a Henschel mixer at 26 m/s for 5 minutes. Sample Nos. 18 to 20 were prepared by adjusting the mixing ratio of toner:additive a:additive b:additive c was 100:1:1:0 or 100:1:1:0.3 by weight. Sample Nos. 20 and 21 are inventive samples, and sample Nos. 18 and 19 are comparative samples.

A developer was prepared using the resulting toner composition and evaluated in the same manner as in Example 1. The results of evaluation are shown in Table 2 below.

TABLE 2

| | Composition of Additives | | | | Developer Characteristics | |
|---|---|---|---|---|---|---|
| Sample | Additive a | | Additive | Additive | Image Grade (Scratches on Photo- | Powder |
| No. | No. 1 | No. 10 | b | c | receptor) | Fluidity |
| 18 | 1% | — | 1% | — | G5 | Δ |
| 19 | 1% | — | 1% | 0.3% | G5 | Δ |
| 20 | — | 1% | 1% | — | G0 | Δ |
| 21 | — | 1% | 1% | 0.3% | G0 | Δ |

On account of the aforesaid constitution, the electrophotographic toner composition according to the present invention exhibits excellent fluidity. Further, since titanium oxide particles are prevented from being agglomerated and adhered to the surface of a photoreceptor in the form of a band of several to ten microns in width and about 1 μm in height. Therefore, even when a photoreceptor is cleaned with a cleaning blade to remove the residual toner therefrom, streaky scratches are not made on the photoreceptor and, as a result, reduction in graininess due to the scratches, especially, on full color images can be avoided.

While the invention has been described in detail and with reference to specific embodiments thereof, it will be apparent to one skilled in the art that various changes and modifications can be made therein without departing from the spirit and scope thereof.

What is claimed is:

1. A toner composition for electrophotography comprising (i) toner particles comprising a binder and a colorant and (ii) an additive, wherein said additive is crystalline titanium dioxide fine particles (a) which have been treated with a coupling agent and (b) which have a specific surface area of 60 to 100 $m^2/g$ and a Karl Fischer moisture content of not more than 5% by weight, said coupling agent being a compound represented by formula (I), (II) or (III):

$$R^1Si(X)_3 \quad (I)$$

$$R^{1'}R^2Si(X)_2 \quad (II)$$

$$R^{1'}R^2R^3SiX \quad (III)$$

wherein $R^1$ represents an alkyl group having 10 to 20 carbon atoms; $R^{1'}$ represents an alkyl group having 1 to 20 carbon atoms; $R^2$ and $R^3$ each represents a hydrogen atom, an alkyl group having 1 to 20 carbon atoms or an aryl group having 6 to 30 carbon atoms; and X represents a chlorine atom, an alkoxy group having 1 to 10 carbon atoms or an acetoxy group having 3 to 5 carbon atoms.

2. The toner composition for electrophotography as claimed in claim 1, wherein $R^1$ and $R^{1'}$ each represents an alkyl group having 10 to 20 carbon atoms.

3. The toner composition for electrophotography as claimed in claim 1, wherein said crystalline titanium dioxide fine particles have a primary particle size of not more than 20 nm.

4. The toner composition for electrophotography as claimed in claim 1, wherein said crystalline titanium dioxide fine particles have a primary particle size of from 5 to 20 nm.

5. The toner composition for electrophotography as claimed in claim 1, wherein said toner particles have an average particle size of from 5 to 9 μm.

6. The toner composition for electrophotography as claimed in claim 1, wherein said coupling agent is used in an amount of 0.1 to 25% by weight based on said crystalline titanium dioxide fine particles.

7. The toner composition for electrophotography as claimed in claim 1, wherein said crystalline titanium dioxide fine particles have a moisture content of not more than 3.5% by weight.

8. The toner composition for electrophotography as claimed in claim 1, wherein said crystalline titanium dioxide fine particles have a specific surface area of 70–95 $m^2/g$.

9. The toner composition for electrophotography as claimed in claim 1, wherein said additive comprises said crystalline titanium dioxide fine particles in anatase form having a specific gravity of about 3.9.

10. The toner composition for electrophotography as claimed in claim 1, wherein said additive comprises said crystalline titanium dioxide fine particles in rutile form having a specific gravity of about 4.2.

11. The toner composition for electrophotography as claimed in claim 1, wherein said binder comprises at least one of the group consisting of homopolymers, and copolymers, of styrene, dienes, vinyl esters, α-methylene aliphatic monocarboxylic acid esters, vinyl ethers and vinyl ketones; polyester resins; polyamide resins; polyimide resins; or polyurethane resins.

12. The toner composition for electrophotography as claimed in claim 1, wherein said binder is a linear polyester resin formed by polycondensation of bisphenol A and an aromatic polycarboxylic acid.

13. The toner composition for electrophotography as claimed in claim 12, wherein said linear polyester is formed from terephthalic acid/bisphenol A-ethylene oxide adduct/cyclohexanedimethanol, and further having a softening point of from 90° to 150° C., a glass transition point of from 50° to 70° C., a number average molecular weight of from 2,000 to 6,000, a weight average molecular weight of from 8,000 to 150,000, an acid value of from 5 to 30, and a hydroxy group value of from 25 to 45.

14. The toner composition for electrophotography as claimed in claim 12, wherein said linear polyester is formed from terephthalic acid/bisphenol A-ethylene oxide adduct/cyclohexanediol, and further having a softening point of from 100° to 125° C., a glass transition point of from 55° to 68° C., a number average molecular weight of from 3,000 to 3,600, a weight average molecular weight of from 9,000 to 10,000, an acid value of from 6 to 12, and a hydroxy group value of from 25 to 40.

15. A toner composition for electrophotography comprising (i) toner particles comprising a binder and a colorant and (ii) an additive wherein said additive is crystalline titanium dioxide fine particles, in at least one of a rutile form and an anatase form, (a) that have been treated with a coupling agent and (b) that have a rice-grain shape, a primary particle size of about 150 to 3000 Å, a specific surface area of 60–100 $m^2/g$, about $1.4\times10^{20}$ hydroxy groups on the surface of said particles per gram of particles, and a Karl Fischer moisture content of not more than 5% by weight of said particles, said coupling agent being a compound represented by formulae (I), (II) or (III):

$$R^1Si(X)_3 \quad (I)$$

$$R^{1'}R^2Si(X)_2 \quad (II)$$

$$R^{1'}R^2R^3SiX \quad (III)$$

wherein $R^1$ represents an alkyl group having 10 to 20 carbon atoms; $R^{1'}$ represents an alkyl group having 1 to 20 carbon atoms; $R^2$ and $R^3$ each represents a hydrogen atom, an alkyl group having 1 to 20 carbon atoms or an aryl group having 6 to 30 carbon atoms; and X represents a chlorine atom, an alkoxy group having 1 to 10 carbon atoms or an acetoxy group having 3 to 5 carbon atoms.

* * * * *